US011486669B2

(12) United States Patent
Bowers

(10) Patent No.: US 11,486,669 B2
(45) Date of Patent: Nov. 1, 2022

(54) BAFFLE COMPONENT FOR A SOUND SUPPRESSOR

(71) Applicant: Bowers Group, LLC, Cornelius, OR (US)

(72) Inventor: Thomas A. Bowers, Cornelius, OR (US)

(73) Assignee: Bowers Group LLC, Cornelius, OR (US)

( * ) Notice: Subject to any disclaimer, the term of this patent is extended or adjusted under 35 U.S.C. 154(b) by 312 days.

(21) Appl. No.: 16/866,384

(22) Filed: May 4, 2020

(65) Prior Publication Data

US 2021/0341247 A1 Nov. 4, 2021

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS

| | | | | |
|---|---|---|---|---|
| 4,588,043 | A * | 5/1986 | Finn | F41A 21/30 89/14.4 |
| 6,575,074 | B1 | 6/2003 | Gaddini | |
| 7,987,944 | B1 * | 8/2011 | Brittingham | F41A 21/30 89/14.4 |
| 9,328,984 | B2 * | 5/2016 | Shults | F41A 21/325 |
| 9,410,761 | B2 * | 8/2016 | Morris | F41A 21/30 |
| 10,018,440 | B2 * | 7/2018 | Shults | F41A 21/30 |
| 10,054,382 | B2 * | 8/2018 | Palu | F41A 21/30 |
| 2020/0182578 | A1 * | 6/2020 | Turnblom | F41A 21/30 |
| 2021/0381791 | A1 * | 12/2021 | Magee | F41A 21/30 |

* cited by examiner

*Primary Examiner* — Joshua T Semick
(74) *Attorney, Agent, or Firm* — Klarquist Sparkman, LLP

(57) ABSTRACT

A baffle for sound suppression, the baffle including a conical portion, a base portion, a lumen, and a cavity. The conical portion has a first end, a second end, and an outer surface extending from the first end to the second end and the base portion has a first surface and a second surface, the first surface and second surface being directed away from each other. The lumen has an inner surface and inner lip, the inner surface extending from the first end of the conical portion to the second surface of the base portion and the inner lip extending outwardly from and circumferentially around the inner surface and the cavity located between the first end and the second end of the conical portion and extending from the outer surface of the conical portion to the inner surface of the lumen.

24 Claims, 7 Drawing Sheets

BAFFLE COMPONENT FOR A SOUND SUPPRESSOR

FIELD

The present disclosure relates to sound suppression for firearms.

BACKGROUND

When a firearm is discharged, the hot and pressurized gas often trapped entirely behind the round and within the barrel of the firearm is released and reacts rapidly to the unpressurized and relatively cool atmosphere surrounding the firearm as the round exits the muzzle. This rapid decompression and cooling of the gas results in the shock wave, or blast of sound emitted from the firearm which can range anywhere from 140 to 175 decibels. To reduce the decibel level, sound suppressors are configured with a unitary or a series of baffle structures to decrease the gas temperature and pressure released from the firearm by allowing the gas to expand and cool within the sound suppressor before interacting with the surrounding atmospheric conditions. As a result, sound suppressors can reduce sound made by a firearm between about 20 and 45 decibels, which not only preserves hearing health, but improves a user's accuracy and response to recoil of the firearm as well as reduce, or in some cases eliminate, muzzle flash caused by the burning gases exiting the barrel. However, numerous efforts to further improve sound suppression have resulted in little to no improvement. Thus, further advancement in firearm sound suppression beyond the capabilities of current sound suppressors is desired in the field.

SUMMARY

According to an aspect of the disclosed technology, a representative embodiment of a baffle for sound suppression includes a conical portion, a base portion, a lumen, and a cavity. The conical portion has a first end, a second end, and an outer surface extending from the first end to the second end and the base portion has a first surface and a second surface, the first surface and second surface being directed away from each other. The lumen has an inner surface and inner lip, the inner surface extending from the first end of the conical portion to the second surface of the base portion and the inner lip extending outwardly from and circumferentially around the inner surface. The cavity is located between the first end and the second end of the conical portion and extends from the outer surface of the conical portion to the inner surface of the lumen.

In some embodiments, the lumen has a first lumen segment and a second lumen segment, the first lumen segment extending from the first end of the conical portion to the second lumen segment and the second lumen segment extending from the first lumen segment to the second surface of the base portion. In further embodiments, the inner surface of the lumen has an inner surface cavity, the inner surface cavity extending over a portion of the first lumen segment and the second lumen segment. In other embodiments, the first lumen segment has a first lumen diameter and the second lumen segment has a second lumen diameter, wherein the second lumen diameter increases from the first lumen segment to the second surface of the base portion. In further embodiments, the cavity and the inner surface cavity are oriented between 165 degrees and 195 degrees from each other. In other embodiments, diametrically opposing portions of the inner surface of the second lumen segment form an angle between about 120 degrees and 150 degrees.

In some embodiments, the lip is located at the first end of the conical portion and forms an entry of the baffle. In some embodiments, the outer surface of the conical portion has a ridge portion extending circumferentially around the conical portion and proximate to the second end of the conical portion and the first surface of the base portion. In other embodiments, the cavity extends from the first end of the conical portion to a point located between the first end and the second end of the conical portion.

In some embodiments, the baffle includes a plurality of the baffles as described herein, each baffle being aligned coaxially along a common longitudinal axis. In further embodiments, the plurality of baffles along the common longitudinal axis are arranged in an alternating series such that the cavity of each baffle is oriented between about 80 degrees and 190 degrees relative to the cavity of the immediately preceding and/or succeeding baffle. In some embodiments, the plurality of baffles are housed and aligned within a cannister.

In another representative embodiment, a baffle for sound suppression includes a tapered portion, an annular portion, a central lumen, an outer cavity, and an inner cavity. The tapered portion has an outer surface, a first outer diameter at a first end of the tapered portion, and a second outer diameter at a second end of the tapered portion, wherein the first outer diameter is less than the second outer diameter. The annular portion has a third outer diameter that is greater than the second outer diameter of the tapered portion and the central lumen extends through the tapered portion and the annular portion, the central lumen having a first segment, a second segment, and a third segment. The outer cavity extends along a portion of the tapered portion and between the outer surface of the tapered portion to the first segment and second segment of the central lumen and the inner cavity extends along a portion of the second segment and the third segment of the central lumen.

In some embodiments, each segment of the central lumen has a respective length, wherein the length of the first segment is less than or equal to the length of the third segment and the length of the third segment is less than the length of the second segment. In some embodiments, each segment of the central lumen has a respective diameter such that the first segment has a first lumen diameter, the second segment has a second lumen diameter, and the third diameter has a third lumen diameter, wherein the first lumen diameter is less than the second lumen diameter and the second lumen diameter is less than the third lumen diameter.

In some embodiments, the tapered portion has a ridge extending circumferentially around the tapered portion proximate to the second end and the annular portion, wherein the ridge has a ridge diameter greater than or equal to the second diameter of the second end of the tapered portion. In further embodiments, the outer cavity extends from the first end of the tapered portion to the ridge. In other embodiments, a length of the tapered portion is greater than a length of the annular portion. In further embodiments, the baffle includes a longitudinal axis extending along the central lumen and through the tapered portion and annular portion, wherein the third segment of the central lumen forms an angle between about 55 degrees and 80 degrees relative to the longitudinal axis.

In another representative embodiment, a firearm suppressor includes at least one baffle including a base having a substantially cylindrical outer wall surface and an annular first rim surface extending substantially perpendicularly to the outer wall surface and having a first outer diameter. The baffle further including a substantially frusto-conical extension having an outer surface extending from the first rim surface and terminating at a second rim surface, the second rim surface having a second outer diameter less than the first outer diameter. The base and extension have a bore extending therethrough and defining a substantially frusto-conical inner surface and a substantially cylindrical inner bore wall surface extending from the inner surface toward the second rim surface. The extension having a cutout opening extending from the first rim surface to the second rim surface and the inner surface having a cavity formed in a portion of its inner surface.

In some embodiments, the cutout opening and cavity are angularly displaced from one another relative to a bore axis extending through the baffle. In further embodiments, the cutout opening and cavity are diametrically opposed to one another relative to the bore axis. In other embodiments, the second rim surface defines an overhanging lip with respect to the bore. In further embodiments, the firearm suppressor including a housing to support the baffle, the housing having attachment means for attaching the suppressor to a barrel of the firearm.

The foregoing and other objects, features, and advantages of the invention will become more apparent from the following detailed description, which proceeds with reference to the accompanying figures.

DETAILED DESCRIPTION

Figure 1:
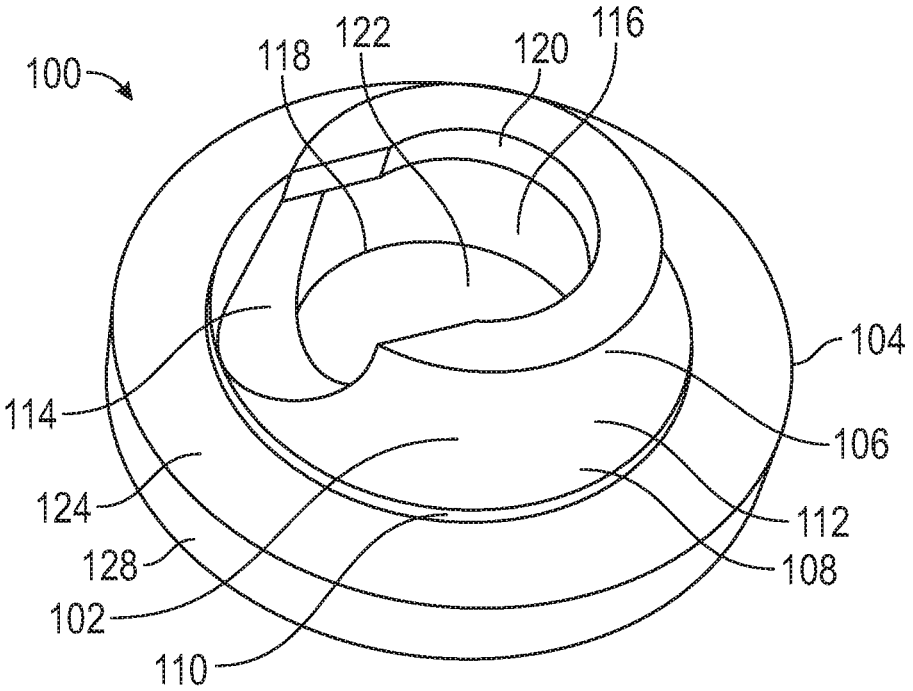
FIG. 1 is a first perspective view of a baffle, according to a first embodiment.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present, or problems be solved. Any theories of operation are to facilitate explanation, but the disclosed systems, methods, and apparatus are not limited to such theories of operation.

In some examples, values, procedures, or apparatus are referred to as "lowest," "best," "minimum," or the like. It will be appreciated that such descriptions are intended to indicate that a selection among many used functional alternatives can be made, and such selections need not be better, smaller, or otherwise preferable to other selections.

As used in the application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside," "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

The following description makes several references to dimensions and/or other values to describe various features of the disclosed technology. Such dimensions are not, however, intended to be absolute or exhaustive but are utilized to discuss various configurations of the technology. Each dimension and/or value expressly contained herein are also considered to include both the express value(s) and/or range of values within an allowable amount of variation of the specified quantity (e.g., a tolerance), including values expressed in terms of a "minimum" and/or a "maximum." For example, each decimal value and/or range of values used herein are considered to include both the express value(s) as well as values within plus or minus 0.250 of the specified value, no matter the unit. Likewise, an angle and/or range of angles are considered to include both the express angle values as well as the angle values within plus or minus 12.5 degrees of the specified angle. Similarly, each fraction used herein is considered to include both the express value as well as values plus or minus ¼ of the specified value.

Sound suppressors often colloquially referred to as "silencers," include one or more baffle structures configured and arranged within a canister to cool and depressurize the gas released from the muzzle of the discharged firearm to which the sound suppressor is coupled. These baffles structures are integral for sound suppression, as the baffle structures allow the gas exiting the muzzle of the firearm to expand and circulate thereby reducing the temperature and pressure difference between the gas and the atmosphere conditions surrounding the firearm. Sound suppressors, both past and present, have had an overall significant impact on hearing health and shooter experience. As the technology of sound suppression systems has advanced however, incremental improvements to reach further reductions in the decibel levels emitted have become increasingly difficult and important, as a reduction of even a few decibels exhibit significant benefits over current system designs.

FIGS. 1-8 show an exemplary baffle 100 that can be used in various sound suppression systems to further reduce the sound emitted from the firearm by at least 3 decibels than those reduced decibel levels currently achieved by other suppressors. The configuration of the baffle 100, alone and/or in combination with one or more baffles 100, allows the hot and highly pressurized gas leaving the muzzle to be moved efficiently around within a sound suppression system such that the gas cools and expands before interacting with the surrounding environment by way of one or more cavities within the baffle and the dimensions of its individual features. A plurality of the baffle as described herein can, for example, can be aligned such that each baffle is coaxially aligned with each of the other baffles.

Figure 5:
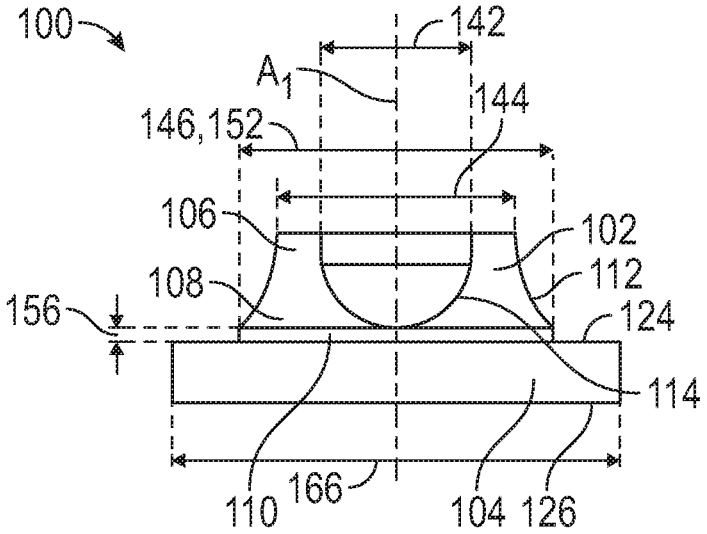
FIG. 5 is a first side view of the baffle.
Figure 6:
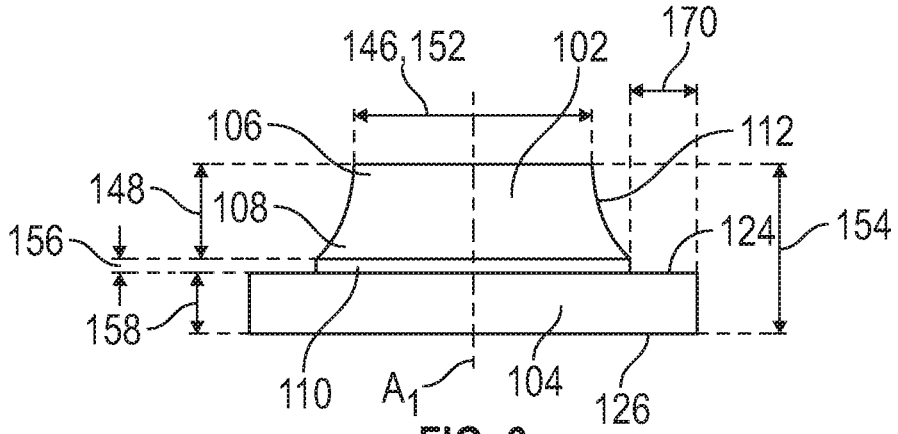
FIG. 6 is a second side view of the baffle.

Referring to FIG. 1, the baffle 100 of the present disclosure includes a conical portion 102 and a base portion 104. The conical portion 102 includes a first end 106, a second end 108, and a ridge 110 extending circumferentially around the lower most portion of the conical portion 102 which is proximate to the second end 108 and the base portion 104. The conical portion 102 includes an outer surface 112 that extends from the first end 106 to the second end 108 and along the ridge 110 to the base portion 104. In the illustrated embodiment, the conical portion 102 also includes an outer cavity 114 extending along the length (e.g., length 148 of FIG. 6) and/or a portion of the conical portion 102. For example, as shown in FIG. 1, the outer cavity 114 extends from the first end 106 of the conical portion 102 to the upper most edge of the ridge 110 proximate to the second end 108 and closely positioned to the first end 106. Although the illustrated embodiment of FIG. 1 shows the outer cavity 114 terminating at the ridge 110, in some embodiments, the outer cavity 114 can extend along some length of the ridge 110 (e.g., the length 204 of the ridge 202 as shown in FIGS. 5 and 6) and/or terminate between the first end 106 and the second end 108 (e.g., as in FIG. 14) or ridge 110 as further described herein.

Figure 2:
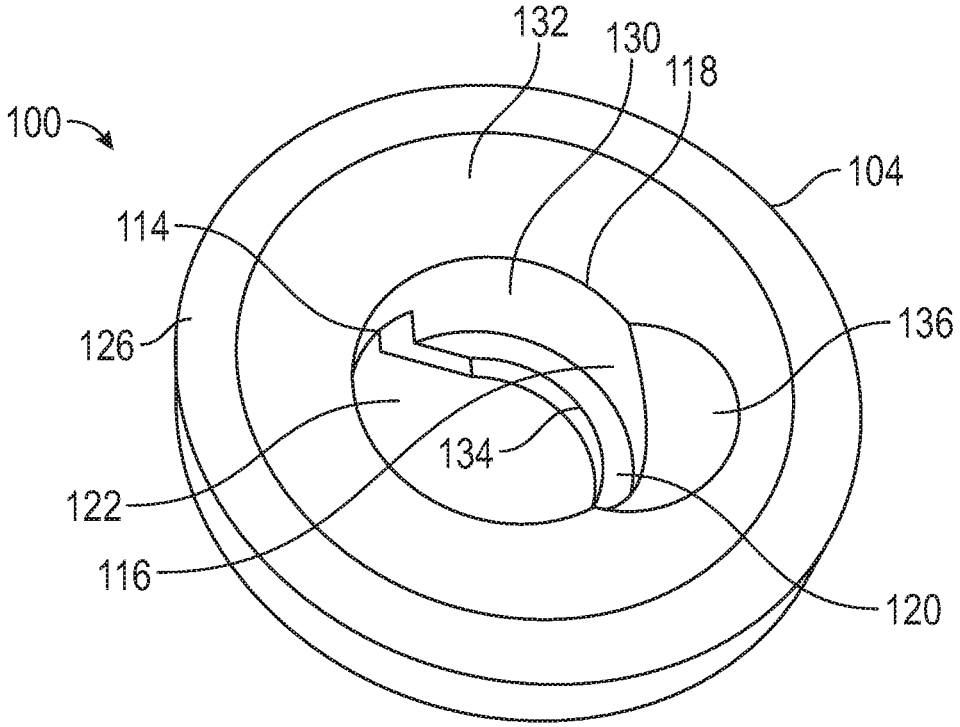
FIG. 2 is a second perspective view of the baffle of FIG. 1.

FIG. 1 also shows that the outer cavity 114 extends from and through the outer surface 112 of the conical portion 102 to an inner surface 116 of an inner lumen 118, the lumen 118 being a bore and/or bore wall extending centrally along the entire length of the baffle 100, through both the conical portion 102 and the base portion 104. As such, the outer cavity 114 extends through an inner lip 120 at the first end 106 of the conical portion 102. As shown in FIG. 2, the inner lip 120 extends outwardly from the inner surface 116 of the lumen or bore 118 and circumferentially around the first end 106 situated outside of the outer cavity 114. The inner lip 120, for example, can be a counterbore to form the inner flat surface within the lumen 118 at the first end 106 of the conical portion 102. In this manner, the first end 106 of the conical portion 102, the lumen 118, and inner lip 120 form an entry 122 of the baffle 100 for a round (e.g., a bullet and/or cartridge) to pass therethrough.

Referring to FIGS. 1 and 2, the base portion 104 includes a first inwardly facing surface 124 (e.g., facing outwardly and in the direction of the conical portion 102) proximate to the conical portion 102, a second outwardly facing surface 126 (e.g., facing outwardly and away from the conical portion 102), and a side surface 128 extending circumferentially around the outer most portion of the base portion 104 and between the first surface 124 and second surface 126.

As shown in FIG. 2, the lumen 118 and inner surface 116 can include two or more segments. For example, the portion of the inner surface 116 centrally located within the baffle 100 and proximate to the inner lip 120 can form a first segment 130 that extends a substantial length of the baffle 100 and/or lumen 118, as discussed herein. While the portion of the inner surface 116 extending from the first segment 130 to the second surface 126 of the base portion can form a second segment 132. In addition to the first and second segments 130, 132, the surface extending along the inner lip 120 (e.g., the surface of the inner lip 120 facing inward to the center of the lumen 118 and downward to the second surface 126 of the base portion 104) can form a third segment 134 proximate to the first segment 130. As discussed herein, each of the segments 130, 132, 134 can have diameters that differ along the length of the baffle 100.

Still referring to FIG. 2, the baffle 100 includes a second cavity 136 disposed within the inner surface 116 of the lumen 118. The inner cavity 136, for example, can extend over a portion of both the first segment 130 and the second segment 132. Additionally, or alternatively, the inner cavity 136 can extend over a single segment, such as the first segment 130 or the second segment 132.

Figure 3:
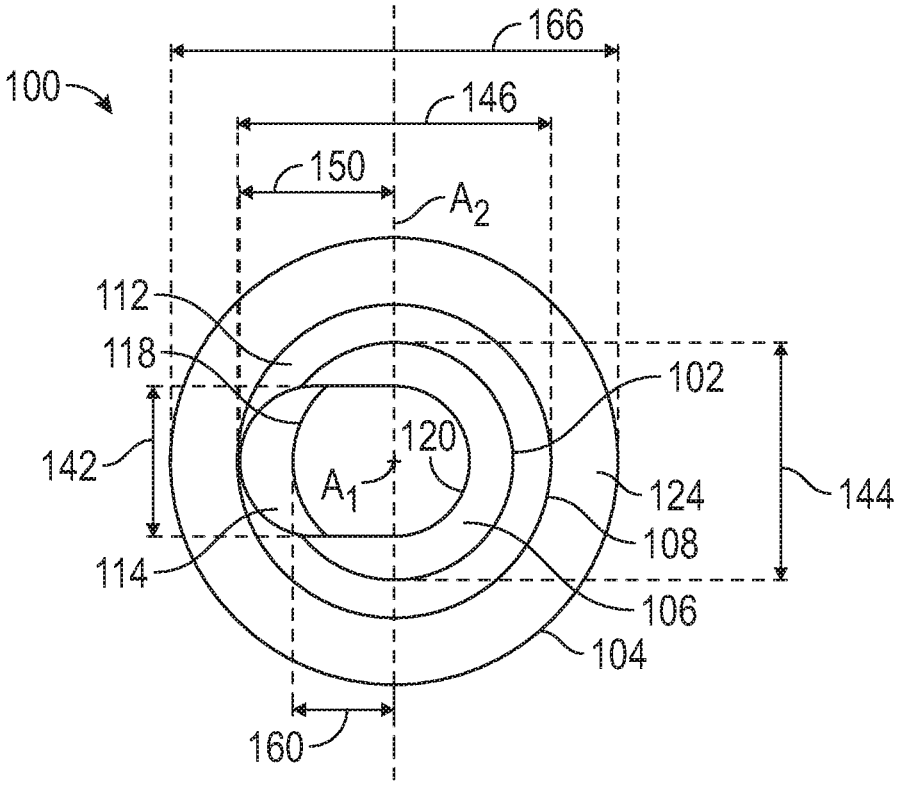
FIG. 3 is top view of the baffle.
Figure 4:
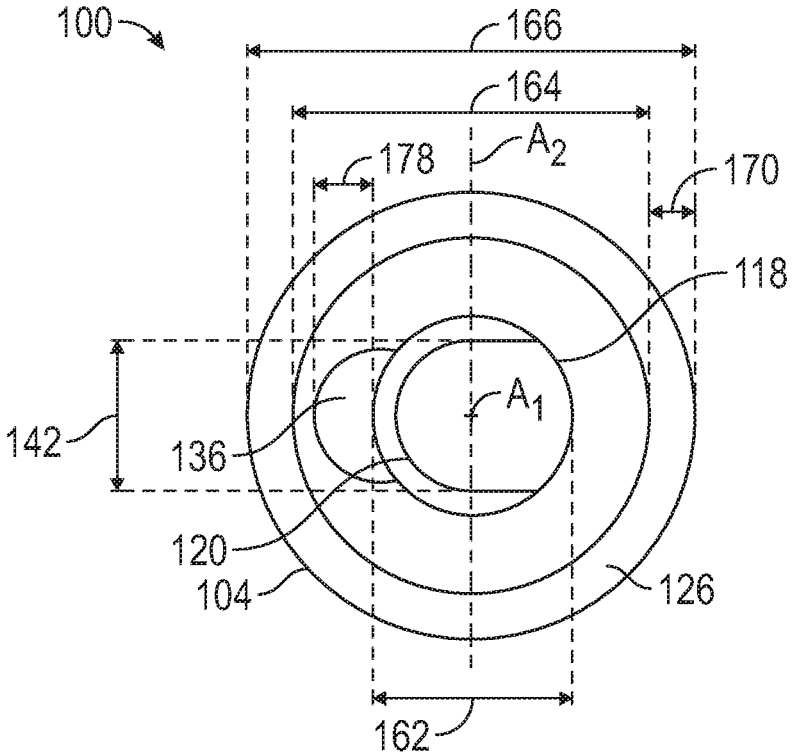
FIG. 4 is a bottom view of the baffle.

FIGS. 3 and 4 show that the outer cavity 114 and the inner cavity 116 can be positioned (and/or approximately positioned) 180 degrees relative to one another about (e.g., around) the longitudinal axis A1. For example, FIGS. 3 and 4 show opposite facing portions of the baffle 100 (e.g., the first end 106 of the conical portion being directed toward the viewer, and directed away from the viewer, respectively), such as if the baffle 100 were pivoted 180 degrees about an axis A2 perpendicular to the longitudinal axis A1 (e.g., directed inward and outward of the plane of FIGS. 3 and 4). As such, the outer cavity 114 and the inner cavity 136 can be arranged diametrically opposed about the longitudinal axis A1, such as to provide improved air circulation around one or more baffles. In some embodiments, the outer and inner cavities 114, 136 of an individual baffle 100 can be arranged between 160 degrees and 200 degrees relative to one another about the longitudinal axis A1.

Figure 16:
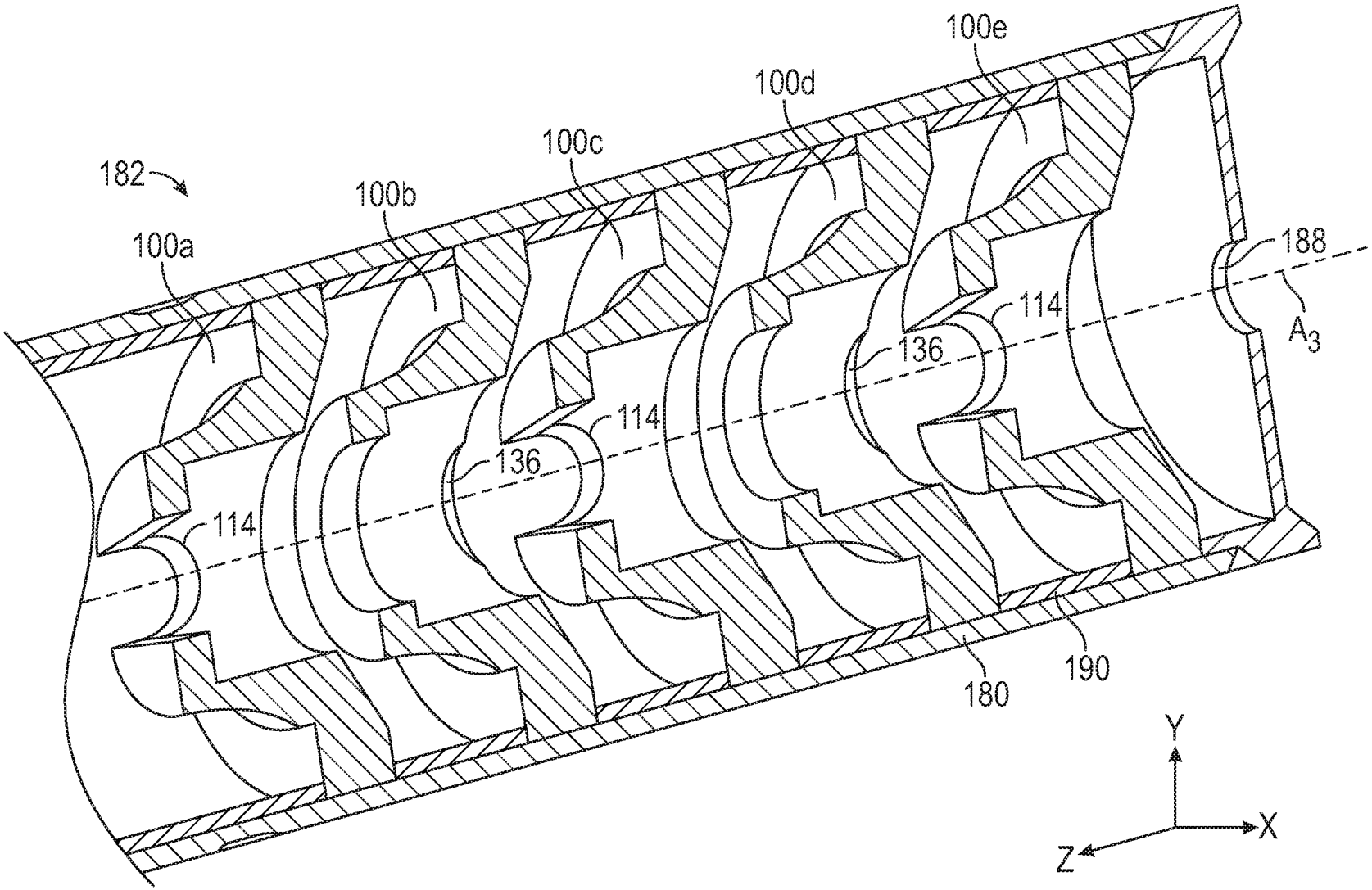
FIG. 16 is a cross-sectional view of a sound suppression system comprising a plurality of the baffles arranged along a common axis.

Accordingly, as shown in FIG. 16, a plurality of the baffles 100*a-e* as described herein can be aligned (e.g., stacked) coaxially along a common axis A3 (e.g., the longitudinal axis A1 of the baffle) within a housing 180 (e.g., canister) to form a sound suppression system 182 which is configured to attach to the barrel of a firearm. As such, a round exiting the barrel of an attached firearm travels along (or substantially along) the common axis A3 through each of the baffles 100*a-e* (e.g., the conical and base portions 102, 104) and the exit 188 of the housing 180, while the gas exiting the firearm is allowed to cool and expand along the system 182. In some embodiments, each baffle 100 within a plurality of baffles 100*a-e* can be oriented (e.g., rotated) 180 degrees relative to the immediately preceding and/or succeeding baffle 100 about the longitudinal axis A3. For example, the outer and inner cavities 114, 136 of a first baffle 100*a* can be oriented in a first position relative to the housing 180 while a second baffle 100*b* can be oriented in a second position relative to the first baffle 100*a* such that the outer and inner cavities 114, 136 of the second baffle 100*b* are oriented 180 degrees (or substantially 180 degrees) relative to the inner and outer cavities 114, 136 of the first baffle 100*a*. In this manner, the orientation of each baffle 100*a-e* can be altered and/or alternated along the length of the baffle, for example, such that the cavity of each baffle is oriented between about 80 degrees and 190 degrees relative to the cavity of the immediately preceding and/or succeeding baffle. In particular embodiments, the cavity of each baffle is oriented between about 90 degrees and 180 degrees relative to the cavity of the immediately preceding and/or succeeding baffle. In other embodiments, each baffle within a plurality of baffles 100*a-e* can be aligned along a common axis 180 such that the outer and inner cavities 114, 136 of each of the baffles are aligned along the length of the housing 180.

Similarly, a plurality and/or series of baffles can be configured in various arrangements and/or oriented in any manner relative to one another. For example, two or more adjacent baffles 100 at an entry of the suppression system (e.g., system 182) can be offset by 180 degrees (or substantially 180 degrees) relative to one another while each subsequent baffle is offset by 90 degrees (or substantially 90 degrees) relative to the immediately preceding (and/or succeeding) baffle. In some embodiments, an individual baffle can be oriented at any angle relative to any single and/or each individual baffle within the system (e.g., between 0 degrees and 360 degrees). As such, the arrangement of baffles (e.g., baffles 100*a-e*) within a sound suppressor can be modified to accommodate various applications. For example, as the dimensions and/or proportions of the baffle are altered and/or scaled in size, the arrangement and/or orientation of the baffles 100 can be modified to produce optimal sound suppression for a particular caliber round, firearm, and/or other consideration.

The baffle 100 can be formed from a cast, billet, printed, and/or combination thereof of one or more various materials including, but not limited to, titanium, stainless steel, Inconel, satellite, maraging steel, aluminum, chrome moly steel, steel generally, ceramic, polymer, and/or any combination thereof. For example, the baffle 100 can be formed from a billet of stainless steel and a bore extending therethrough to form the features of the baffle as described herein, such as to define a substantially frusto-conical inner surface and a substantially cylindrical inner bore wall surface extending from the inner surface toward a second rim surface. Accordingly, the baffle can be formed and/or configured in various ways and to meet particular specifications, such as for durability or disposability, and/or for semi- and fully automatic applications.

Still referring to FIG. 16, each baffle 100 within a sound suppression system 182 can also be spaced within the housing 180 by one or more spacers 190 configured to space the baffles by a consistent and/or varying distance along the housing. Although embodiments of the baffle are described herein as individual baffles that can be stacked and aligned to form a suppression system, one or more of the disclosed baffles can be configured into a monolithic baffle (e.g., unitary structure) according to the principles discussed herein, and can also be configured to incorporate a spacing structure protruding forward and/or rearward along the longitudinal axis.

The configuration of the baffle 100 (and/or plurality of baffles) as described herein, allows the air (e.g., gas, vapor, and/or liquid) surrounding the round and within the sound suppressor to be exchanged across the baffle 100 (e.g., between the first surface 124 and the second surface 126 of the base portion 104) by way of the lumen 118 and the outer and inner cavities 114, 136. For example, as the round initially crosses the outer most plane formed by the first end 106 and entry 122, the gas is circulated through the lumen 118 and outer cavity 114 ahead of the round (e.g., in the same and/or opposite direction of the round) while the inner cavity 136 within the lumen 118 draws gas away from the path of the round. As such, the pressurized and high temperature gas exiting the firearm is pulled away from the path of trajectory and the lumen 118 thereby allowing the gas to expand and cool more efficiently and reducing, for example, unwanted yawing of the round which can affect shot accuracy. Additionally, the configuration of the baffle 100 (and/or plurality of baffles) provides increased structural integrity and resistance under extreme heat, functions within wide variations of pressure, and/or minimizes point of impact shift (e.g., versus the point of impact of the unsuppressed firearm). In this manner, the baffle 100 of the present disclosure can be adapted, scaled, and/or modified to fit a number of different applications, such as different caliber firearms and/or ammunition such that various firearms can benefit from the improvement in sound suppression the baffle 100 provides.

Now referring to FIGS. 3-8, the individual features of the baffle 100 can also have a dimensional and/or proportional relationship to one another. FIGS. 3-6 show, for example, that the inner and outer diameters of the individual portions increase along the length 154 and toward the base portion 104 of the baffle 100. For the purpose and ease of discussion without limiting the present disclosure, some of the diameters and radii of the baffle 100 are discussed in relation to the longitudinal axis A1 of baffle 100 (e.g., pointing inward/outward of the plane of the page and/or extending centrally along the length of the baffle 100).

As shown in FIG. 3, the first end 106 of the conical portion 102 outside of the outer cavity 114 has an inner diameter 142 between diametrically opposing points of the inner surface of the inner lip 120 and an outer diameter 144 between diametrically opposing points of the outer most edges of the first end 106. While the second end 108 of the conical portion 102 has a diameter 146 that is greater than the inner and outer diameters 142, 144. Accordingly, the outer surface 112 of the conical portion 102, which extends from the first end 106 to the second end 108, tapers (i.e. narrows) from the second end 108 to the first end 106 (e.g., FIGS. 5 and 6) and can therefore, may be referred to as a tapered portion. As shown in FIGS. 5 and 6, the outer surface 112 is curved inwardly toward the longitudinal axis A1 and along the length 148 of between the first and second ends 106, 108. However, in some embodiments, the outer surface 112 can be curved to extend outwardly from the longitudinal axis and/or linear along its length.

In the illustrated embodiment of FIGS. 3 and 5-6, the radius 150 of the second end 108 is equal to (or substantially equal to) the outer most point and radius of the outer cavity 114. This spatial relationship between the radius 150 of the second end 108 and the radius of the outer most point of the outer cavity 114 is due to the outer cavity 114 extending through the outer surface 112 and terminating at the second end 108 and/or at the edge of the ridge 110 most proximate to the second end 108. In some embodiments however, the outer cavity 114 can terminate at a point between the first end 106 and second end 108 and/or beyond the second end 108, such that the radius of the outer most point of the outer cavity 114 from the longitudinal axis A1 is respectively less than or greater than the radius 150 of the second end 108. Further, it is noted that the ridge 110 of the baffle 100 of FIGS. 1-8 has a diameter 152 and a radius that are equal to (or substantially equal to) the radius 150 and the diameter 146 of the second end 108. This is a result of the ridge 110 being perpendicular to (or substantially perpendicular to) the first surface 124 of the base portion 104 and extending directly from the second end 108. As discussed herein however, the ridge 110 can alternatively have a diameter greater than the diameter 146 of the second end 108 (see FIGS. 11-13).

As shown in FIGS. 5 and 6, the baffle 100 can have an overall length 154 which extends from the first end 106 to the second surface 126. The overall length 154 includes the length 148 that extends between the first end 106 and second end 108 of the conical portion 102, the length 156 of the ridge 110 of the conical portion 102, and the length 158 of the base portion 104. As described herein, the length 148 is greater than the length 158 of the base portion 104 and the length 158 of the base portion 104 is greater the length 156 of the ridge 110. In some embodiments, the length 158 of the base portion 104 is greater than or equal to (or substantially equal to) the length 148 and the length 156 of the ridge 110. In other embodiments, each length of the baffle 100 can be equal and/or have various dimensions relative to one another.

Figure 7:
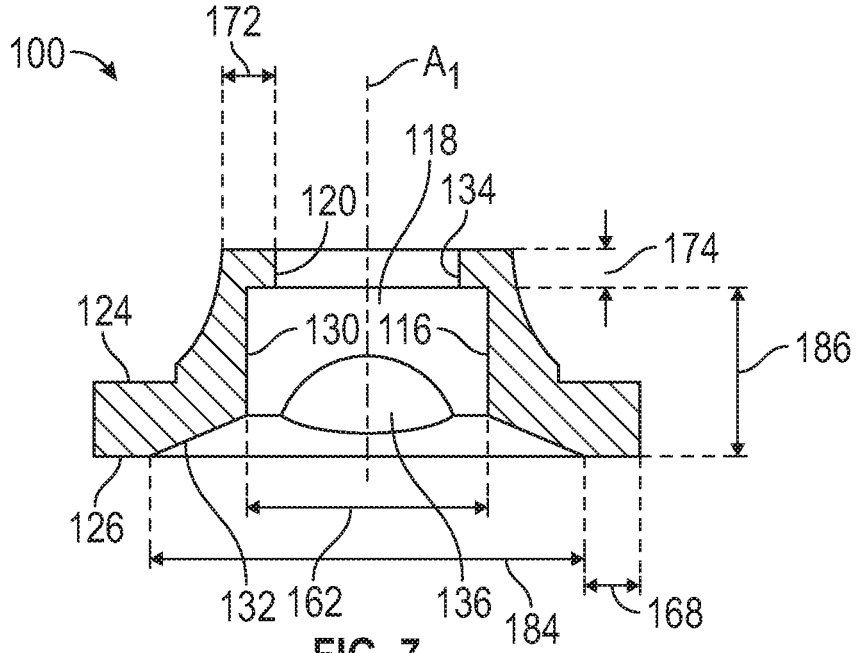
FIG. 7 is a first cross-sectional view of the baffle bisected by a plane extending along a longitudinal axis of the baffle such that an inner cavity of the baffle is centrally located.
Figure 8:
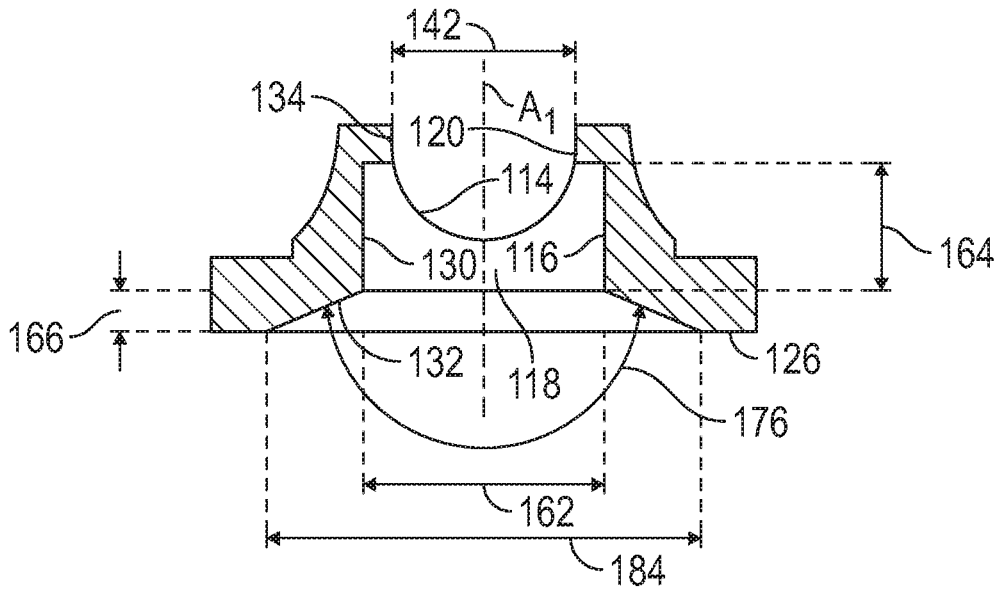
FIG. 8 is a second cross-sectional view of the baffle bisected by the plane extending along the longitudinal axis of the baffle such that an outer cavity is centrally located and diametrically opposed to the inner cavity of FIG. 7.

Referring to FIGS. 3 and 7-8, the bore or lumen 118 can have respective diameters corresponding to the two more segments of the lumen 118. For example, the first segment 130 of the lumen 118 can have a radius 160 extending from the longitudinal axis A1 to the inner surface 116 of the lumen 118 and a diameter 162 extending between diametrically opposing points of the inner surface 116. As shown in FIGS. 7 and 8, the first segment radius 160 and diameter 162 can be unchanging along the length 164 of the first segment 130. Additionally, or alternatively, the first segment radius 160 and diameter 162 can increase and/or decrease along the length 164 such as the radius and diameter of the second segment 132. For example, the radius and diameter of the second segment 132 of the lumen 118 can increase (or alternatively decrease) along its length 166 from a first diameter 162 (e.g., the diameter of the lumen 118) to a second diameter 184 such that the second segment 132 is tapered inward from the second surface 126 of the base portion 104 to the first segment 130 of the lumen 118. As such, diametrically opposing faces of the second segment 132 can from an angle 176 between 120 degrees and 150 degrees relative to one another. In this manner, the base portion 104 of the baffle 100 may be referred to as an annular or circular portion. In some embodiments, the first diameter 162 of the second segment 132 is equal to (or substantially equal to) the diameter of the first segment 130. In other embodiments, the second diameter 184 of the second segment can be equal to (or substantially equal to) a radius and diameter of the base portion 104.

As shown in FIGS. 3-5, the base portion 104 can have a base diameter 166 which is greater than each of the diameters (and corresponding radii) of the other features of the baffle 100, including the second diameter 184 of the second segment 132 of the lumen 118. As such, a width 168 of the second surface 126 is determined by the difference between the diameters 164, 166 of the second segment 132 and base portion 104. Similarly, a width 170 of the first surface 124 of the base portion 104 is determined by the difference between the diameters 146, 166 of the second end 108 and the base portion 104.

Additionally, the inner diameter 142 of the first end 106 corresponds to the diameter of the third segment 134. Thus, the diameter of the third segment 134 is equal to (or substantially equal to) the inner diameter 142 of the first end 106. As such, the lumen 118 can include at least the first segment 130, second segment 132, and third segment 134, each with a different radius and diameter. Further, as shown in FIG. 7, an outer width 172 of the inner lip 120, which can define the perimeter of the entry 122, is determined by the difference between the inner and outer diameters 142, 144 of the first end 106, while the length 174 of the third segment 134 is the difference between the overall length 154 and the sum of the lengths 186 of the first and second segments 130, 132 (e.g., lengths 164, 168).

As stated herein, the dimensions and/or proportions of the individual features of the baffle 100 can be adapted, scaled, and/or modified for suitable use in a number of different applications, such as for different caliber firearms and ammunition. By way of example, the baffle 100 illustrated in FIGS. 1-8 can have dimensions within the allowable variance (e.g., tolerance) stated herein for appropriate inclusion within a sound suppression system for a .460 caliber (i.e., 0.460 inch) projectile. For example, the inner diameter 142 (and therefore, the diameter of the third segment 134) and outer diameter 144 of the first end 106 of the conical portion 102 are 0.520 inches and 0.796 inches, respectively. The second end 108 (and therefore, the ridge 110) of the conical portion 102 has a diameter value of 1.048 inches and the diameter 166 of the base portion 104 has a value of 1.495 inches. According to the embodiments of FIGS. 1-8, the diameters 162 of the first segment 130 and second segment 132 of the lumen 118 have a value of 0.670 inches and the second segment 132 of the lumen 118 has a second diameter 184 of 1.210 inches. As such, diametrically opposing surfaces of the second segment 132 can form an angle 176 of 135 degrees relative to one another or a single surface of the second segment can form an angle of 67.5 degrees relative to the longitudinal axis A1.

Regarding the individual lengths of the baffle 100 for the 0.460 inch projectile, the length between the first end 106 and the second end 108 of the conical portion 102 is 0.318 inches, the base portion 104 has a length 158 of 0.208 inches, and the baffle 100 has an overall length 154 of 0.569 inches. Consequently, the ridge 110 has a length 156 of 0.043 inches. Since the lumen 118 extends the entire length of the baffle 100, the overall length of the lumen 118, including the first segment 130, second segment 132, and third segment 134, is 0.569 inches. Within the overall length of the lumen 118, the first segment 130 has a length 164 of 0.357 inches, the second segment 132 has a length 166 of 0.112 inches, and the third segment 134 has a length 174 of 0.100 inches.

As shown in FIGS. 5 and 6, the outer cavity 114 can have a length that is equal to (or substantially equal to) the length 148 extending between the first end 106 and second end 108 of the conical portion 102. The outer cavity 114 can also have a width that is equal to (or substantially equal to) the inner diameter 142 of the first end 106 and the entry 122 of the baffle 100. In the illustrated embodiment, the outer cavity 114 can be formed and/or shaped by advancing, for example, a 0.500-inch ball end mill 0.318 inches deep within (and through) a portion of the outer surface 112 and wall of the conical portion 102 at (or approximately at) 90 degrees relative to the conical portion 102 and the longitudinal axis A1. Similarly, the inner cavity 136 can be formed and/or shaped by advancing, for example, half of a 0.500-inch ball end mill 0.276 deep (e.g., on 0.500 inches bolt circle) at 0 degrees relative to and along an axis parallel to the longitudinal axis A1. As such, the inner cavity 136 can have a radius 178, as shown in FIG. 4, measured from the outer most edge of the inner cavity 136 to a point equal (or substantially equal to) the radius of diameter 162. In some embodiments, the radius 178 is equal (or substantially equal to) the radius of the ball end mill and/or other component used to form the inner cavity 136 (e.g., 0.500 inches). In other embodiments, the radius 178 extends between the diameter 162 of the first and second segments 130, 132 and the second diameter 184 of the second segment 132.

Accordingly, each of the above dimensions can be modified and scaled to adapt the dimensions of the baffle 100 to other caliber applications, such as 9 mm., .50 caliber, etc. For example, the baffle 100 can be configured with the appropriate dimensions for a .22 caliber Long Rifle (LR) sound suppression system. As such, the diameter 146 of the second end 108 of the conical portion 102 is reduced from the 1.048 inches of the 0.460 projectile configuration to 0.532 inches, the diameter 166 of the base portion 104 is reduced to 0.898 inches from 1.495 inches, and the inner diameter 142 of the first end 106 is reduced to 0.275 inches from 0.520 inches. For comparison, the inner diameter 142 of the first end 106 can increase in size (e.g., scaled in size) to a value of 0.570 for .50 caliber applications and between .220 inches and 0.450 inches for 9 mm applications.

In a similar manner, the dimensions and configuration of the baffle for one application can be suitably sized and scaled up or down for a different application by modifying one or more features of the baffle while leaving other features unchanged. For example, dimensions of the baffle 100 for the .22 LR can be modified and configured for use in a sound suppression system to accommodate 5.56 NATO and/or .223 Remington rounds. Such as by maintaining (or similarly maintaining) the dimensions of the inner diameter 142 of the first end 106 at 0.275 inches, but by scaling down the diameter 166 of the base portion 104 to a 0.1375-inch diameter. Likewise, the diameter 146 of the second end 108 of the conical portion 102 can be scaled proportionally as the diameter 166 of the base portion 104 is increased and/or decreased. As such, the dimensions of any one or more of the features of the baffle 100 can be held constant while one or more features are scaled and/or modified.

Now referring to FIGS. 9-15, further embodiments of the baffle can be achieved by modifying and/or omitting features relative to and/or in combination with other features. To illustrate this principle, for example, FIGS. 9-13 show that the ridge of the conical portion can be modified relative to the other features of the baffle. Although the description that follows discusses modifications (e.g., scaling, alterations, etc.) to the ridge, the same principles can be applied to any feature, alone or in combination with the other features, to achieve a number of various baffle configurations for a wide range of applications. In some embodiments, modifying one feature determines the dimensions of one or more other features of the baffle as described herein.

Figure 9:
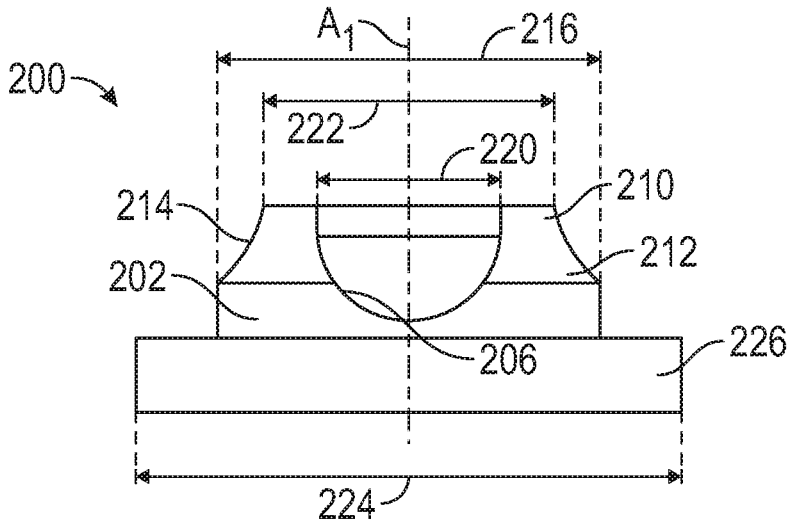
FIG. 9 is a first side view of the baffle according to a second embodiment.
Figure 10:
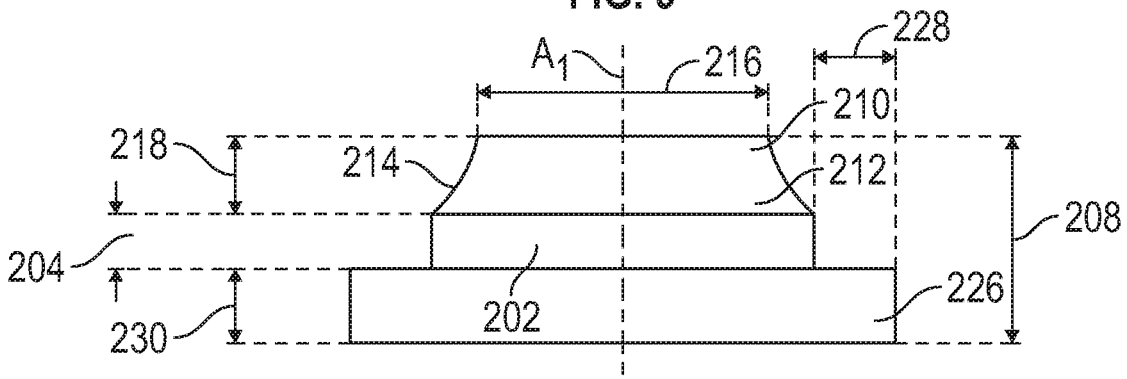
FIG. 10 is a second side view of the baffle of FIG. 9.

As shown in FIGS. 9 and 10, the baffle 200 can be configured to include a ridge 202 that has a length 204 such that the outer cavity 206 extends along at least a portion of the length 204. As a result, in some embodiments, one or more features of the baffle 200 are proportionally modified. For example, a particular sound suppressor may call for a ridge 202 having a length 204 as shown in FIG. 10 and a baffle 200 with an overall length 208 that is equal (or substantially equal) to the overall length 154 (e.g., 0.569 inches) of the baffle as described in reference to FIGS. 3-8, including the length 158 of the base portion 104. Hence, as the length 204 of the ridge 202 is increased, the length 218 extending between the first end 210 and the second end 212 of the conical portion 214 may be proportionally decreased. Thus, the length 204 of the ridge 202 can, for example, be 0.143 inches as opposed to the 0.043 inches of the ridge 110 as described herein in reference to FIGS. 1-8, while also maintaining the diameter 216 of the ridge 202 (e.g., 1.495 inches). As such, the length 218 between the first end 106 and second end 108 of the conical portion 214 can be reduced to 0.218 inches.

In like manner, the dimensions of the other features of the baffle 200 can be maintained and/or proportional as described herein, including those dimensions corresponding to the inner and outer diameters 220, 222 of the first end 210, the diameter 216 of the second end 212 (and therefore, the ridge 202), and the diameter 224 of the base portion 226. Similarly, the width 228 of the first surface 232, the width 220 (e.g., inner diameter 220) of the outer cavity 206, and the length 230 of the base portion 226, can also be in similar and/or have equal dimensions and proportion.

Figure 11:
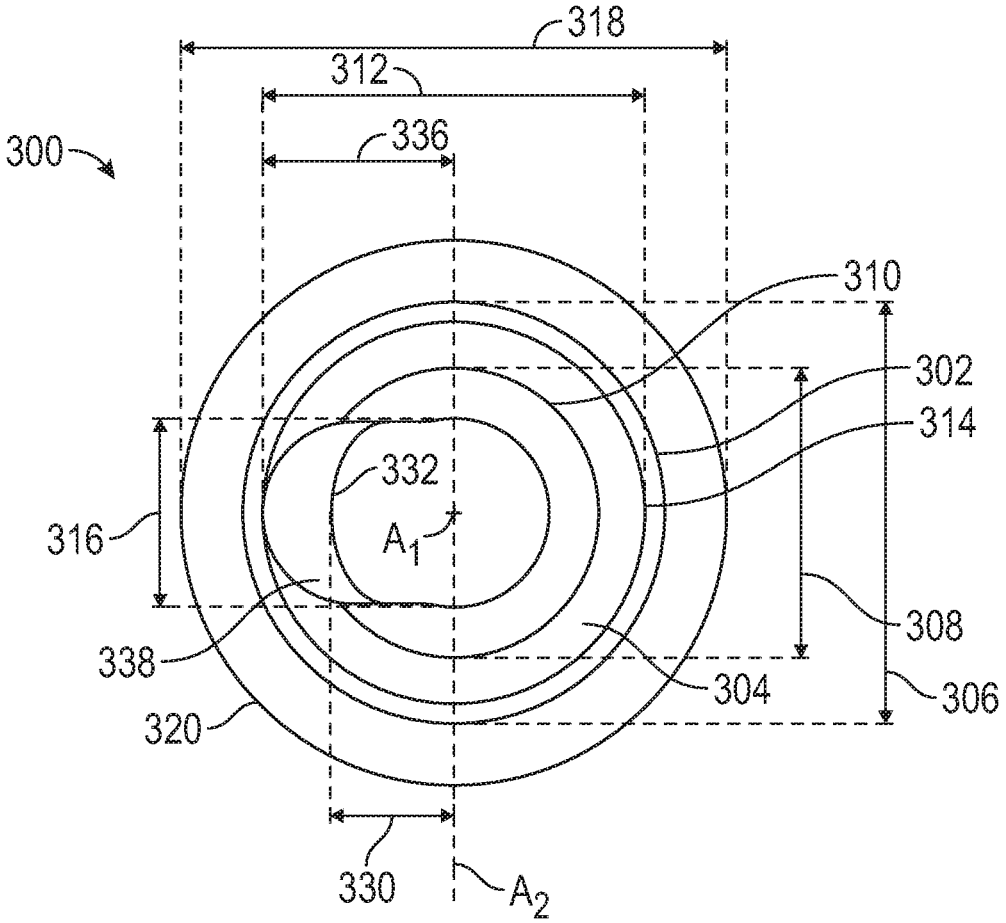
FIG. 11 is a top view of the baffle according to a third embodiment.
Figure 12:
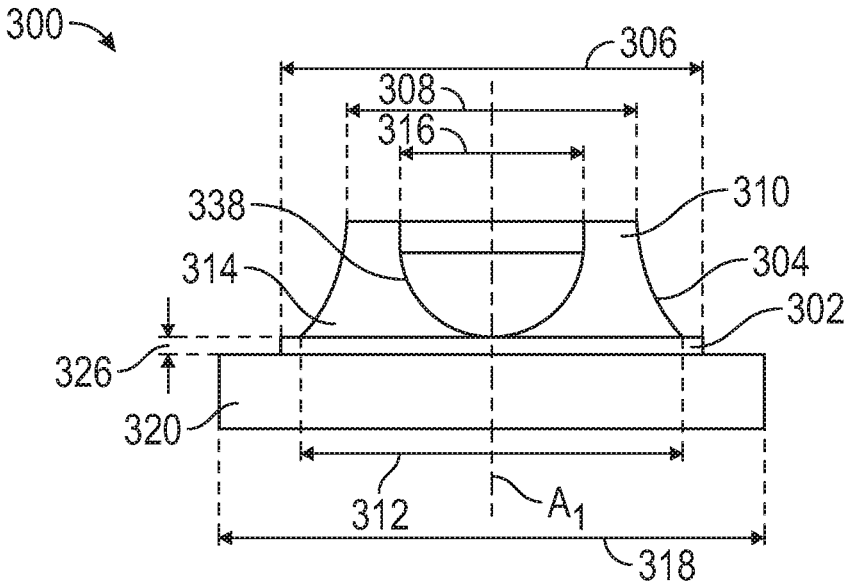
FIG. 12 is a first side view of the baffle from FIG. 11.
Figure 13:
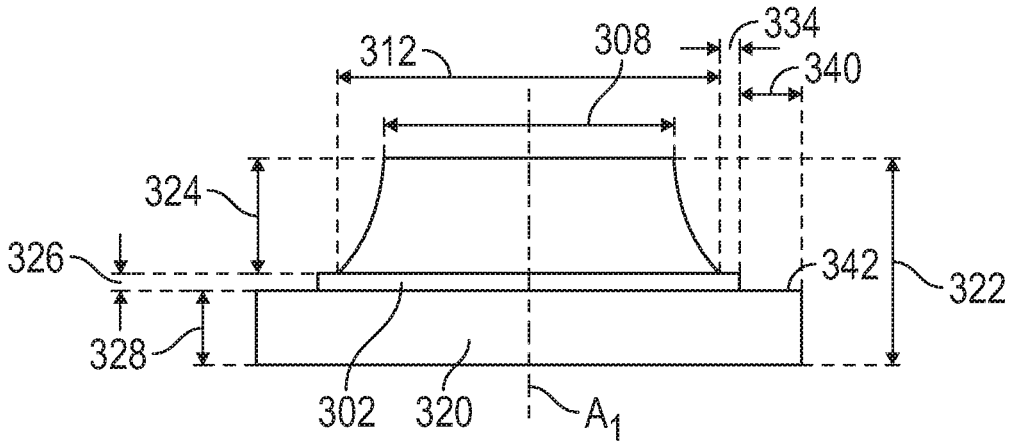
FIG. 13 is a second side view of the baffle from FIG. 11.

Additionally, or alternatively, FIGS. 11-13 show that, in some embodiments, the conical portion 304 of the baffle 300 can have a ridge 302 with a diameter 306 that is greater than the outer diameters 308, 312 of the first end 310 and second end 314. For example, in reference to the dimensions listed for the baffle configured to accommodate a 0.460 projectile (FIGS. 1-8), the diameter 306 of the ridge 302 can have a value of 1.148 inches, while the diameter 312 of the second end 314 can be reduced to 1.048 inches. As a result, a gap or width 334 (e.g., of 0.050 inches) between the second end 314 and an upper surface of the ridge 302 is formed and extends circumferentially around the conical portion 304. Consequently, the outer most point and radius 338 of the outer cavity and second end 304 are less than the radius corresponding to the diameter 306 of the ridge 302.

As shown in FIGS. 11-13, the spatial relationship among the various features of the baffle 300 are equal and/or similar to those dimensions and/or proportions of the other embodiments described herein, such as those in reference to FIGS. 1-10. FIGS. 11-13 show that the inner diameter 316 and outer diameter 308 of the first end 310, the diameter 312 of the second end 314, and the diameter 318 of the base portion 320 can have the same or a similar proportional relationship as other embodiments. In like manner, the overall length 322 of the baffle 300, the radius 330 of the lumen 332 (e.g., diameter of the first segment), the length 328 of the base portion 320, width 340 of the first surface 342 of the base portion, and the length 324 of the conical portion 304, including length 326 of the ridge 302, can also have the same or a similar proportional relationship to those embodiments described in reference to FIGS. 1-10.

Figure 14:
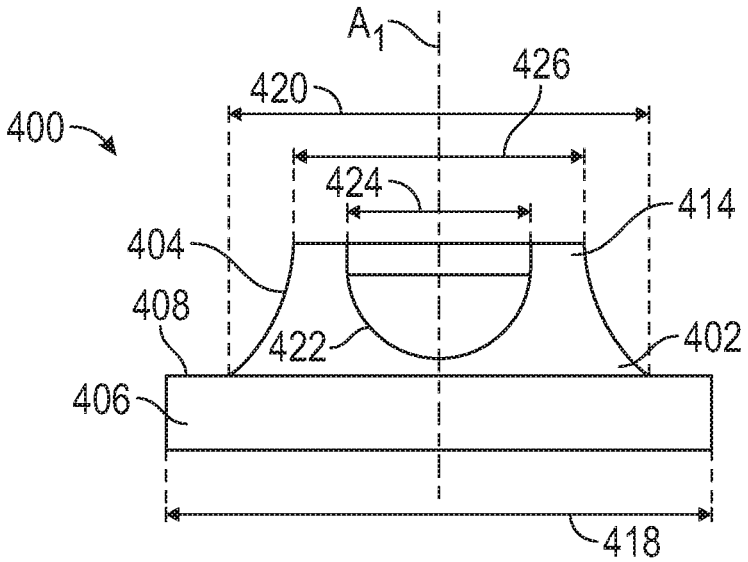
FIG. 14 is a first side view of the baffle according to a fourth embodiment.
Figure 15:
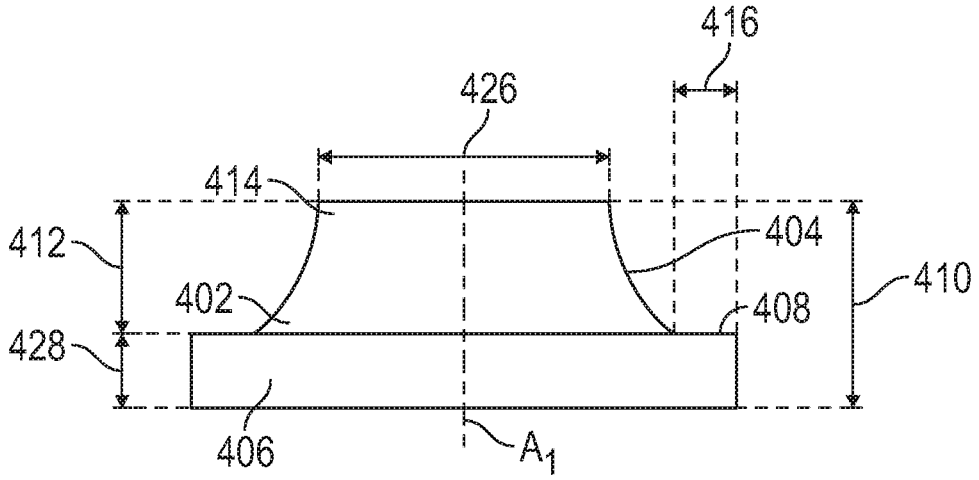
FIG. 15 is a second side view of the baffle from FIG. 14.

Alternatively, as shown FIGS. 14 and 15, the ridge (e.g., ridge 110) can be entirely omitted from the configuration of the baffle 400 such that the second end 402 of the conical portion 404 directly meets the base portion 406 at the first surface 408. In this manner, the conical portion 404 can account for more than (or alternatively less than) half of the overall length 410 of the baffle 400. The conical portion 404, for example, can have a length 412 of 0.361 inches (e.g., between the first and second ends 414, 402) when the overall length 410 of the baffle 400 is 0.569 inches, such as when the baffle 400 is configured to accommodate a 0.460-inch projectile (FIGS. 1-8). As a result, the width 416 of the first surface 408 of the base portion 406 becomes the length between the outer most edge of the base portion 406 at the first surface 408 and where the second end 404 of conical portion 404 meets the first surface 408, as shown in FIG. 15. In other words, the width 416 is difference between the diameter 418 of the base portion 406 and the diameter 420 of the second end 402. Additionally, the outer cavity 422 terminates at a point between the first end 414 and second end 402 of the conical portion 404 rather than terminating or extending beyond the second end 402. As with the other embodiments described herein where the ridge has been modified, the remaining features can have the same, similar, and/or different dimensions and proportions suitable for various applications. In particular and in reference to FIGS. 14 and 15, the inner and outer diameters 424, 426 of the first end 414 and the length 428 of the base portion 406.

Accordingly, in a similar manner as described in reference to FIGS. 9-15, the same principles can be applied to any internal feature (e.g., lumen, inner cavity, etc.), alone or in combination with the other internal and/or outer features, to achieve a number of various baffle configurations for a wide range of applications.

In view of the many possible embodiments to which the principles of the disclosed technology may be applied, it should be recognized that the illustrated embodiments are only preferred examples of the technology and should not be taken as limiting the scope of the technology. Rather, the scope of the technology is defined by the following claims. I therefore claim as my invention all that comes within the scope and spirit of these claims.

The invention claimed is:

1. A baffle for sound suppression, the baffle comprising:

a conical portion having a first end, a second end, and an outer surface extending from the first end to the second end;

a base portion having a first surface and a second surface, the first surface and second surface being directed away from each other;

a lumen having an inner surface and inner lip, the inner surface extending from the first end of the conical portion to the second surface of the base portion and the inner lip extending outwardly from and circumferentially around the inner surface; and a cavity extending longitudinally between the first end and the second end of the conical portion and extending between the outer surface of the conical portion and the inner surface of the lumen;

wherein a radius of the second end of the conical portion and a radial distance to an outermost extent of the cavity relative to a longitudinal axis of the baffle are equal.

2. The baffle of claim 1, the lumen having a first lumen segment and a second lumen segment, the first lumen segment extending from the first end of the conical portion to the second lumen segment and the second lumen segment extending from the first lumen segment to the second surface of the base portion.

3. The baffle of claim 2, the inner surface of the lumen having an inner surface cavity, the inner surface cavity extending over a portion of the first lumen segment and the second lumen segment.

4. The baffle of claim 2, the first lumen segment having a first lumen diameter and the second lumen segment having a second lumen diameter, wherein the second lumen diameter increases from the first lumen segment to the second surface of the base portion.

5. The baffle of claim 3, wherein the cavity and the inner surface cavity are oriented between 165 degrees and 195 degrees from each other.

6. The baffle of claim 2, wherein diametrically opposing portions of the inner surface of the second lumen segment form an angle between about 120 degrees and 150 degrees.

7. The baffle of claim 1, wherein the lip is located at the first end of the conical portion and forms an entry of the baffle.

8. The baffle of claim 1, the outer surface of the conical portion having a ridge portion extending circumferentially around the conical portion and proximate to the second end of the conical portion and the first surface of the base portion.

9. The baffle of claim 8, wherein the cavity extends from the first end of the conical portion to a location along the ridge portion.

10. The baffle of claim 1, wherein the baffle is a first baffle of a plurality of the baffles, wherein the plurality of baffles is aligned coaxially along a common axis.

11. The baffle of claim 10, wherein the plurality of baffles along the common axis is arranged in an alternating series such that the cavity of each baffle is oriented between about 80 degrees and 190 degrees relative to the cavity of the immediately preceding and/or succeeding baffle.

12. The baffle of claim 10, wherein the plurality of baffles is housed and aligned within a cannister.

13. A baffle for sound suppression, the baffle comprising:

a tapered portion, the tapered portion having an outer surface, a first outer diameter at a first end of the tapered portion, and a second outer diameter at a second end of the tapered portion, wherein the first outer diameter is less than the second outer diameter;

an annular portion, the annular portion having a third outer diameter that is greater than the second outer diameter of the tapered portion;

a central lumen extending through the tapered portion and the annular portion, the central lumen comprising a first segment having a first diameter, a second segment having a second diameter, and a third segment having a third diameter, wherein the second diameter of the second segment is uniform along a selected length of the central lumen;

an outer cavity extending along a portion of the tapered portion and between the outer surface of the tapered portion to the first segment and second segment of the central lumen; and an inner cavity extending along a portion of the second segment and the third segment of the central lumen.

14. The baffle of claim 13, wherein a length of the first segment is less than or equal to a length of the third segment, and wherein the length of the third segment is less than the length of the second segment.

15. The baffle of claim 13, wherein the first diameter is less than the second diameter and the second diameter is less than the third diameter.

16. The baffle of claim 13, the tapered portion having a ridge extending circumferentially around the tapered portion proximate to the second end and the annular portion, wherein the ridge has a ridge diameter greater than or equal to the second diameter of the second end of the tapered portion.

17. The baffle of claim 16, wherein the outer cavity extends from the first end of the tapered portion to the ridge.

18. The baffle of claim 13, wherein a length of the tapered portion is greater than a length of the annular portion.

19. The baffle of claim 13, further comprising a longitudinal axis extending along the central lumen and through the tapered portion and annular portion, wherein the third segment of the central lumen forms an angle between about 55 degrees and 80 degrees relative to the longitudinal axis.

20. A firearm suppressor comprising:

at least first and second baffles including a base having a substantially cylindrical outer wall surface and an annular first rim surface extending substantially perpendicularly to the outer wall surface and having a first outer diameter, the first and second baffles further including a substantially frusto-conical extension having an outer surface extending from the first rim surface and terminating at a second rim surface, the second rim surface having a second outer diameter less than the first outer diameter;

the base and extension having a bore extending therethrough and defining a substantially frusto-conical inner surface and a substantially cylindrical inner bore wall surface extending from the inner surface toward the second rim surface;

the extension having a cutout opening extending from the first rim surface to the second rim surface; and the inner surface having a cavity formed in a portion of its inner surface;

wherein the cutout opening and cavity of the first baffle is angularly offset from the cutout opening and cavity of the second baffle about a bore axis extending through the baffles.

21. The suppressor of claim 20, wherein the cutout opening and the cavity of at least one of the first and second baffles are angularly displaced from one another relative to the bore axis extending through the baffle.

22. The suppressor of claim 21, wherein the cutout opening and cavity are diametrically opposed to one another relative to the bore axis.

23. The suppressor of claim 20, wherein the second rim surface defines an overhanging lip with respect to the bore.

24. The suppressor of claim 20, further including a housing to support the first and second baffles, the housing having attachment means for attaching the suppressor to a barrel of the firearm.

* * * * *